US005529129A

United States Patent [19]

Byrd

[11] Patent Number: 5,529,129

[45] Date of Patent: Jun. 25, 1996

[54] HAND-HELD TRENCHING TOOL

[76] Inventor: Ernie Byrd, 109 Shannon, Victoria, Tex. 77904

[21] Appl. No.: 249,966

[22] Filed: May 27, 1994

[51] Int. Cl.[6] ..... A01B 1/00

[52] U.S. Cl. ..... 172/377; 172/378; 294/55

[58] Field of Search ..... 172/370, 371, 172/372, 373, 374, 375, 376, 377, 378, 379, 380, 381, 738; 294/55, 53.5

[56] References Cited

U.S. PATENT DOCUMENTS

| | | | |
|---|---|---|---|
| D. 135,210 | 3/1943 | Sokolis . | |
| 385,283 | 6/1888 | Robinson | 172/377 |
| 492,364 | 2/1893 | Powers | 172/377 |
| 528,607 | 11/1894 | Peat . | |
| 625,629 | 5/1899 | Wyatt | 294/55 |
| 747,206 | 12/1903 | Morgan . | |
| 976,970 | 11/1910 | Wolary | 172/377 |
| 1,043,758 | 11/1912 | Ferwerda | 172/371 |
| 1,505,173 | 8/1924 | Tiemann . | |
| 1,594,984 | 8/1926 | Stafford . | |
| 1,683,395 | 9/1928 | Oakland | 172/738 |
| 1,888,982 | 11/1932 | Elder . | |
| 1,942,557 | 1/1934 | Landa . | |
| 2,037,480 | 4/1936 | Nedbal . | |
| 2,076,120 | 4/1937 | Cyganick | 172/375 |
| 2,127,751 | 8/1938 | Picha | 172/738 |
| 2,351,136 | 6/1944 | Linden | 172/375 |
| 2,364,208 | 12/1944 | Gravely | 172/375 |
| 2,400,241 | 5/1946 | Linden | 172/375 |
| 2,606,050 | 8/1952 | Morris et al. | 172/375 X |
| 2,976,938 | 3/1961 | Rapp | 172/376 |
| 3,226,149 | 12/1965 | McJohnson | 172/375 X |
| 3,435,903 | 4/1969 | Sherrod, Jr. . | |
| 3,522,850 | 8/1970 | Pede | 172/376 |
| 3,915,240 | 10/1975 | Pittman | 172/377 X |
| 4,126,346 | 11/1978 | Burns | 294/55 |
| 4,767,141 | 8/1988 | Martin | 294/55 X |
| 4,982,800 | 1/1991 | Shields | 172/377 X |

*Primary Examiner*—Terry Lee Melius
*Assistant Examiner*—Victor Batson
*Attorney, Agent, or Firm*—Stephen R. Greiner

[57] ABSTRACT

A hand-held trenching tool having a loop-type blade is disclosed. The blade has a projection extending upwardly therefrom for positioning within a socket in a tubular handle. The projection includes a number of laterally spaced bores into which a locking pin may be positioned for selectively securing the blade to the handle. One loop-type blade includes a rectangular base, a pair of trapezoidal side walls extending upwardly from the base, and a rectangular crown connecting the respective tops of the side walls together. Another blade embodiment provides a cylindrical cutting portion having sloping, forward and rearward cutting edges, the forwardmost point of each the cutting edge being at the bottom thereof. The rearward cutting edge may, alternatively, have a plate secured thereto for retaining excavated material within the cylindrical cutting portion.

2 Claims, 3 Drawing Sheets

HAND-HELD TRENCHING TOOL

FIELD OF THE INVENTION

The present invention relates generally to a loop-type hand tool for working the earth.

BACKGROUND OF THE INVENTION

It should be of no surprise to today's urban dwellers that many services are delivered to their homes through hidden conduits buried beneath the ground surface. Electric power, telephone, and television services are now carried through buried cables in many areas. Of course, water and sewer services have traditionally used subsurface flowlines. For authorized repair and extension of service, access to these underground conduits is periodically required.

The excavation of narrow trenches in the soil surface to approach, or install, subsurface utility conduits has always been troublesome. In the past, hand implements such as shovels, picks, and hoes were utilized for this purpose when sufficient manpower was available. Now, however, machine-driven devices are frequently employed in large-scale commercial projects. Nevertheless, these prior art tools have proven to be less than optimal for digging narrow trenches being a few inches in width around human abodes.

When using even the narrowest shovel and hoe blades, more soil is often relocated in excavating an earthen trench than is absolutely necessary. Not only is time and energy wasted in using such tools, but the scar remaining upon the surface of the ground, after backfilling of the trench has been completed, is often unnecessarily large. The alternative, powered trenching machines, cannot be moved into confined areas where utility conduits are frequently placed and are very costly to operate.

It is known that many hand tools including loop-type blades only minimally disturb the soil through which the blades are drawn. Generally, however, the blades of the prior art tools include little more than a substantially rigid loop or band, formed from metallic sheet material and secured to the end of a wooden handle. These bands are frequently narrow in width so that the distance between the opposed cutting edges thereof are on the order of 1 inch (2.5 centimeters) apart. Although ideal for severing near-surface roots with minimal resistance, the prior art blades are not particularly helpful in excavating substantial volumes of earthen material from a trench.

It has been found that by increasing the width of a loop-type blade, its ability to move and carry soil can be increased dramatically without appreciably raising drag forces induced while such is moved through the soil. Sandy soils, for instance, have an angle of repose of approximately 34 degrees making it difficult for the narrow, prior art blades to retain but a small volume of soil material thereon. Thus, a prior art blade having a 1 inch (2.5 centimeter) width is capable of supporting only 0.36 cubic inches (5.9 cubic centimeters) of soil per inch of blade length. However, a tubular or loop-type blade having a 6 inch (15 centimeter) width, heretofore unseen in the prior art, is theoretically capable of retaining 13 cubic inches of soil per inch of blade length. A need, therefore, exists for a trenching tool having a the benefits of a loop-type blade, yet having dimensions sufficiently capable of digging, and rapidly removing relatively large volumes of spoil material from, an earthen excavation.

SUMMARY OF THE INVENTION

In view of the above-mentioned problems, it is a principal object of the present invention to provide a hand-held trenching tool with a tubular blade of predetermined length having a rigid projection extending upwardly therefrom for selective engagement with a close-fitting socket in a handle; the blade being reversible and self-cleaning.

It is a further object of the invention to provide a trenching tool of the type described wherein the projection and the tubular handle each include cooperating bores adapted to receive a locking pin for selectively securing the blade to the handle.

Still another object of the invention is to provide a trenching tool wherein the projection includes a number of laterally spaced bores into which a locking pin may be positioned for selectively varying the length of the tool.

It is another object of the invention to provide a trenching tool with a tubular blade including: a rectangular base, a pair of trapezoidal side walls extending upwardly from the base, and a rectangular crown connecting the respective tops of the side walls together.

It is an additional object of the instant invention to provide a trenching tool of the type described wherein the free edges of the rectangular base and the trapezoidal side walls are sharpened for easy passage through the soil.

Another object of the invention is to provide a trenching tool with a cylindrical blade having forward and rearward cutting edges, each said cutting edge sloping upwardly and rearwardly for reducing frictional drag forces as the blade is moved through the soil.

It is an object of the invention to provide improved elements and arrangements thereof in a hand-held trenching tool for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENTS

Figure 1:
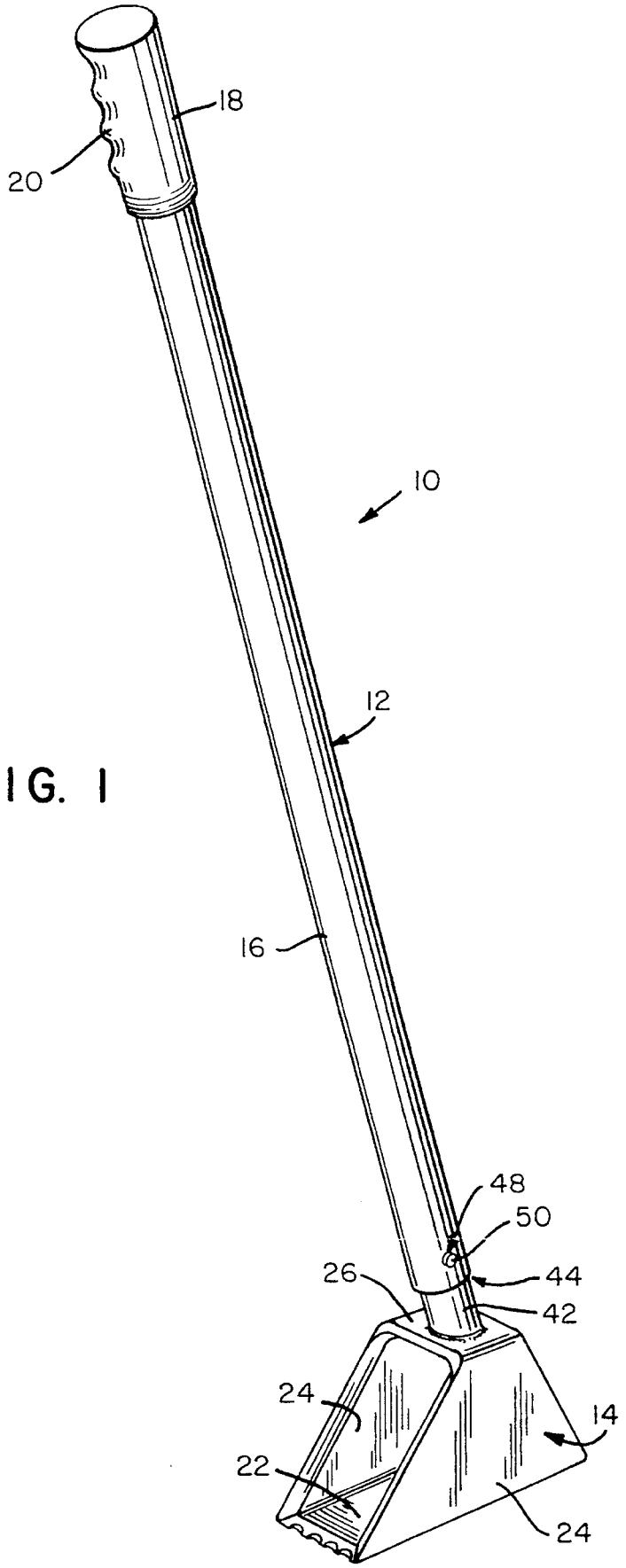
FIG. 1 is a perspective view of a hand-held trenching tool in accordance with the present invention.
Figure 2:
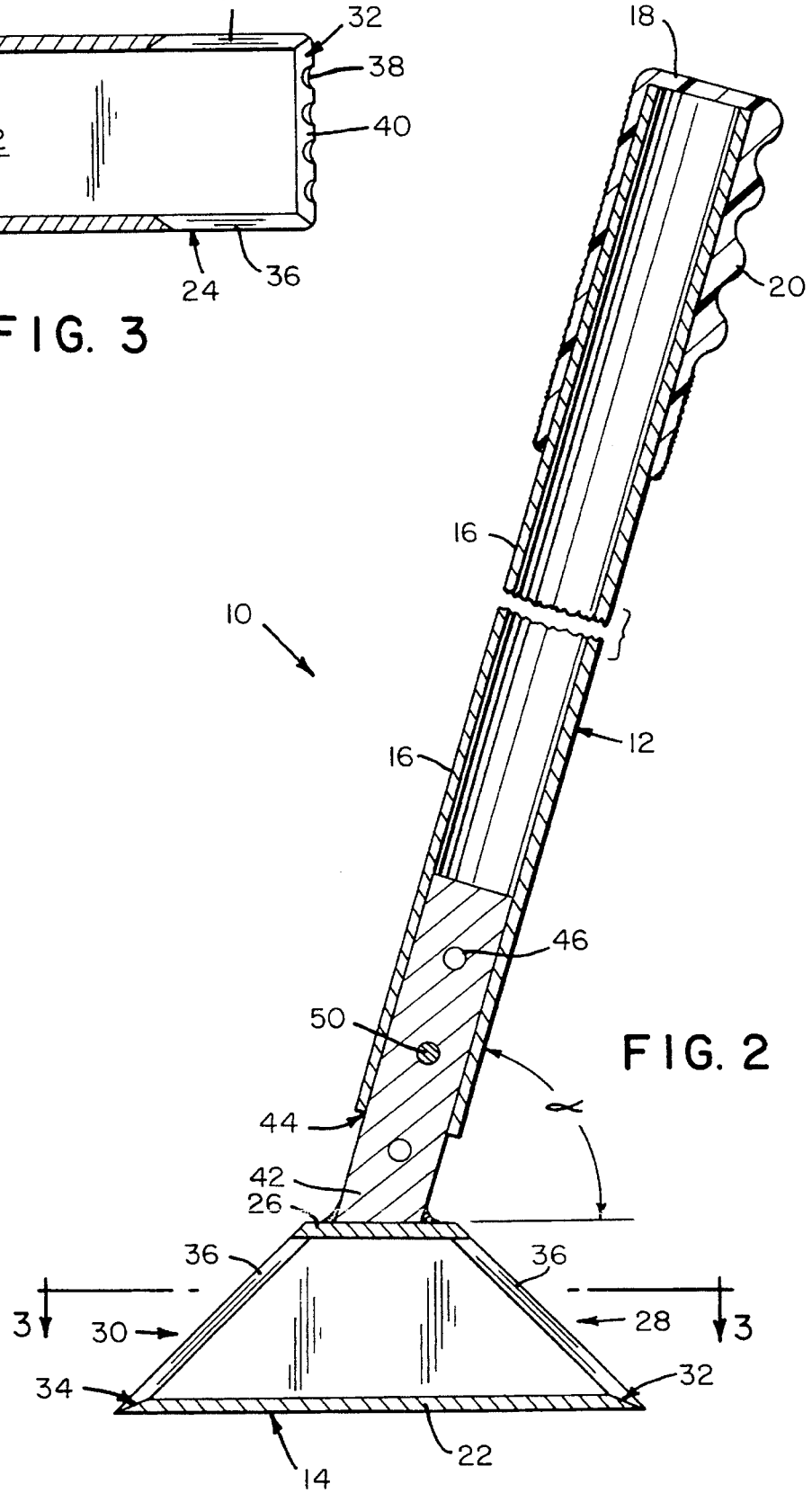
FIG. 2 is vertical cross-sectional view of the hand-held trenching tool of FIG. 1.

Referring now to FIGS. 1 and 2, a hand-held trenching tool 10 in accordance with the present invention is illustrated. The tool 10 comprises a cylindrical handle 12, a loop-type blade 14, and means for securing the blade and handle together in an adjustable fashion. As shown, the blade 14 is provided with sharpened cutting edges on both of its sides. In an alternative form described hereinbelow, a blade being closed at one of its ends so as to form a soil retaining scoop is illustrated.

The preferred handle 12 comprises a metallic tube 16, of any desired length, having a resilient hand grip 18 at its upper end for user comfort. A row of finger-engaging projections 20 extending outwardly from the grip 18 assist the user in holding onto the tool 10 and permit precise control of the blade 14 during trench digging operations. The rubber or plastic material utilized in forming the grip 18 advances the positioning thereof by allowing the grip to stretch slightly when being slipped onto the tube 16 and further assists in retaining the grip in place by returning to its undeformed state after positioning for a persistent snug fit.

The preferred blade 14 is cut from a length of rectangular metal tubing having a height of 3 inches (7.6 centimeters) and a width of 1.5 inches (3.8 centimeters). The blade 14 includes a base 22 at the bottom thereof, a pair of opposed side walls 24 extending upwardly from the base, and a rectangular crown 26 joining the respective tops of the side walls 24 together. The openings 28 and 30 in opposite sides of the blade 14 permit earthen material to enter the blade interior during trench digging operations so as to be temporarily retained there and readily lifted from a shallow excavation.

The base 22 is preferably rectangular in configuration. The free ends of the base 22 are beveled and tempered to provide knife-like cutting edges 32 and 34 spaced approximately 6 inches (15 centimeters) apart. Not only do the beveled edges 32 and 34 permit the blade 14 to slice easily through the soil during use, but they provide a short "ramp" for elevating soil material onto the base 22 with minimal frictional resistance. This ramp is provided with a somewhat shallower incline than that given to the non-parallel edges 36 of the trapezoidal side walls 24.

Figure 3:
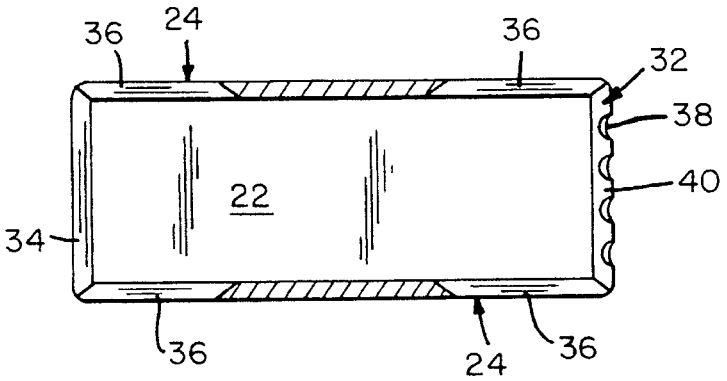
FIG. 3 is cross-sectional view of the trenching blade taken along line 3—3 of FIG. 2.

To further enhance the cutting ability of edge 32, a series of spaced-apart, longitudinal grooves 38 have been machined therein. As shown in FIG. 3, each of the grooves 38 is provided a radius smaller than the width of the beveled edge 32. The upward inclination or slope of each groove 38 is at an angle slightly greater than that of the beveled edge 32 itself. Thus, the individual serrations or teeth 40, formed between each of the grooves 38, has an uninterrupted triangular cross section throughout its length for maximum strength and cutting ability. Although only one edge of the preferred soil cutting blade 14 is serrated, it should be noted that any of the beveled edges of the tool could be similarly dressed in further embodiments of the tool if desired.

The paired side walls 24 are provided with like trapezoidal configurations. The bottom edges of the side walls 24 are both coextensive with the lateral boundaries of the base 22 and, thus, have a lengths equivalent to that of the base. On the other hand, the top edges of the side walls 24 are coextensive with the relatively shorter crown 26. The two, non-parallel edges 36 of each of the trapezoidal side walls 24 slope inwardly from their junction with the base 22 toward the crown 26. The preferred slope of the non-parallel edges 36 is 45 degrees. Such an angle conserves material when a number of blades 14 are successively cut from a single piece of tubing stock, and is believed to permit the blade 14 to penetrate soil material more readily than is possible with similar edges having a more vertical inclination. Resembling the edges 32 and 34 of the base 22, the side wall edges 36 are beveled and tempered to provide a knife-like cutting surface for readily funneling soil material into the blade interior.

A metallic projection or rod 42 is securely affixed to the blade 14 for facilitating the attachment of the blade to the handle 12. As shown in FIGS. 1 and 2, the projection 42 is preferably welded to the crown 26 at an inclination or tilt toward the serrated cutting edge 32. It has been found that an incline of approximately 15 degrees so that when the handle 12 is drawn by an individual of ordinary stature, the blade 14 will be so positioned when using edge 34 that a scraping action along the soil surface will result by reason of the near vertical inclination of the base 22 and when reversing the blade the serrated edge 32 may be readily pulled through the soil as the base 22 is then in a position approximately parallel with the surface thereof.

After positioning the projection 42 within the close-fitting socket 44, the length of the tool 10 may be varied to accommodate the needs of a particular user. For this purpose, the projection 42 includes a series of laterally spaced-apart bores 46 each having a longitudinal axis disposed parallel to the cutting edges 32 and 34. A bore 48 passing through the lower end of the tube 16 and its longitudinal axis may be cooperatively aligned with one of the bores 46. Once done, a close-fitting locking pin 50 may be positioned within the cooperating bores 46 and 48 for securing the blade 14 and handle 12 together in a stable fashion. Of course, the overall length of the tool 10 may be easily increased or decreased from its initial setting by first removing the pin 50 and then realigning a different one of the bores 46 in the projection 42 with the bore 48 in the tube 16 and reinserting the pin 50. To prevent loss during use, the pin 50 may be of a form selected from the usual threaded or cotter pin types (not shown).

In the alternative, after slidably positioning the projection 42 within the socket 44, a weld (not shown) may be employed to permanently secure the blade 14 to the handle 12. In this manner, the projection 42 serves to continuously reinforce the bottom of the handle 12, preventing such from inadvertent collapse when struck against a hard object such as a rock. Further, the added mass of the projection itself provides supplemental momentum to the blade 14 when swung into the soil, thus increasing blade penetration depths and resulting excavation rates.

Figure 4:
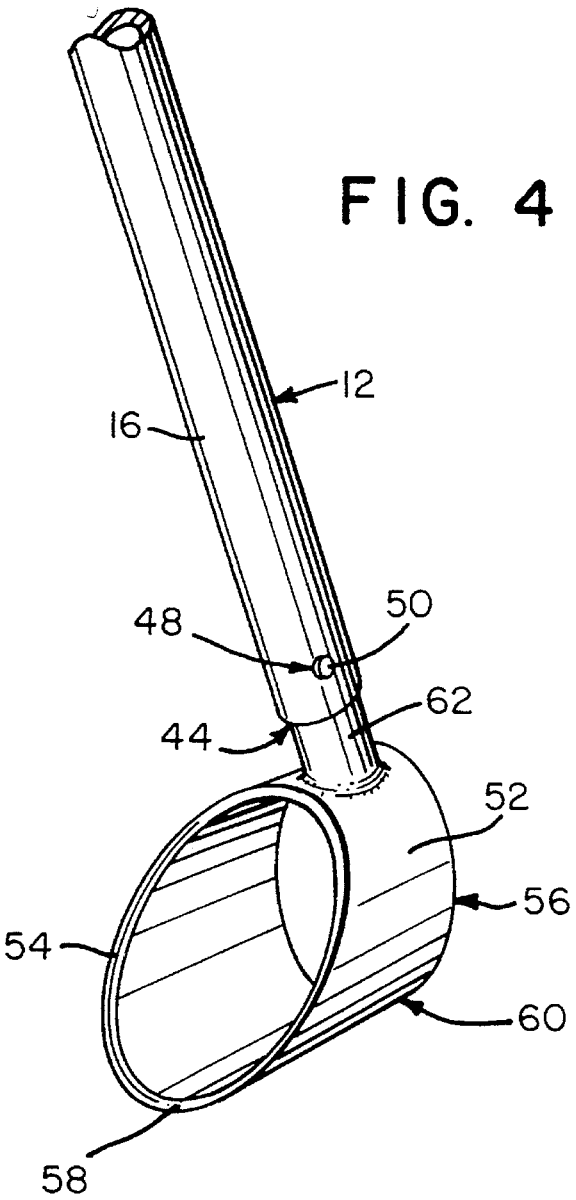
FIG. 4 is perspective view of an alternative embodiment of a trenching blade which may be used as component part of the present invention.

Referring now to FIG. 4, a blade 52 of alternative form is illustrated. The blade 52 is preferably made from a length of cylindrical, metallic tubing which has been cut in the shape of a truncated cylinder. The blade 52 may be of any desired length and is provided with forward and rearward cutting edges 54 and 56 at opposite ends thereof to aid in trench digging operations. The forward cutting edge 54 slopes upwardly and rearwardly from a point or tip 58 at the bottom thereof so as to trace an outline of oval shape within a first plane. Similarly, the rearward cutting edge 56 slopes upwardly and rearwardly from a forwardmost point 60 at the bottom thereof and traces an outline of oval shape within a second plane. Although the forward and rearward cutting edges 54 and 56 may be formed so as to be parallel to one another, the first and second planes containing said cutting edges preferably converge at an acute angle. The junction of these two planes (not shown) is an imaginary, horizontal line in space above the blade 52 and positioned normally to longitudinal axis of the blade itself. By providing the blade 52 with the described configuration, the distance between the forwardmost points 58 and 60 of the cutting edges is maximized for soil retention purposes.

Only one of the cutting edges of the blade 52 need be modified after its initial cutting from tubing stock. In this regard, the forward cutting edge 54 is beveled and tempered to a knife-like sharpness and hardness. As the rearward edge 56 is little used for actual soil cutting operations, special treatment is unnecessary. Its sloping oval surface, without more, has proven to be adequate for scooping up and discharging unconsolidated soil material and the like when necessary.

A metallic projection or rod 62 is securely affixed to the blade 52 for facilitating the attachment of the blade to the handle 12. Like the projection 42 of FIGS. 1 and 2, the projection 62 is preferably welded to the top of the blade 52 at an inclination of approximately 15 degrees toward its principal cutting surface—forward cutting edge 54. The projection 62 itself is dimensioned to be closely fitted within the opening or socket 44 at the bottom of the tube 16.

After fitting the projection 62 within the socket 44, the length of the tool may be varied to accommodate the needs of a particular user. For this purpose, the projection 62 includes a series of laterally spaced-apart bores (not shown) each having a longitudinal axis disposed normally to the longitudinal axis of the blade 52. A bore 48 passing through the lower end of the tube 16 and its longitudinal axis may be cooperatively aligned with one of the bores in the projection. Once done, a close-fitting, locking pin 50 may be positioned within the cooperating bores for securing the blade 52 and handle 12 together in a stable fashion. The overall length of the tool may be increased or decreased from its initial setting by first removing the pin 50 and then realigning a different one of the bores in the projection 62 with the bore 48 and reinserting the pin 50.

Figure 5:
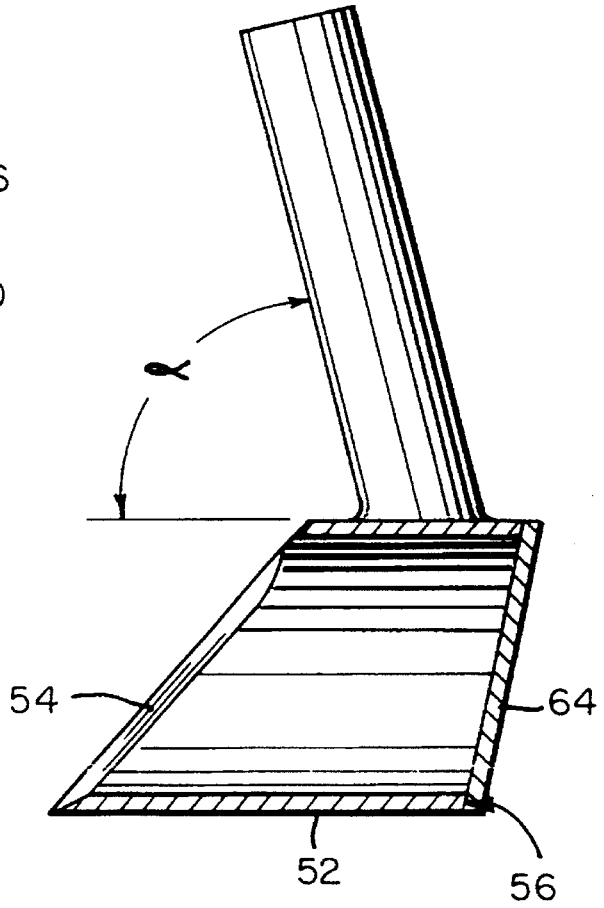
FIG. 5 is vertical cross-sectional view of a modified version of the trenching blade of FIG. 4 having a rearward closure for soil retention purposes.

Referring now to FIG. 5, a modified version of the blade 52 is illustrated. In this particular embodiment, a plate 64 is secured to the rearward cutting edge 56, as by welding about the periphery of the plate. Because, it is often desirable to carry soil material away from the point of its excavation, the secured plate 64 permits such to be accomplished with minimal spillage prior to final disposal.

From the foregoing, it should be apparent that the instant invention may be used advantageously for the purpose of digging trenches in confined locations adjacent building structures, growing shrubs and the like. Handles of variable length may be selectively employed in conjunction with one or more detachable blades of differing configuration to accomplish such a task with maximum user comfort and minimal effort. The tool is self-cleaning, inasmuch as by simply reversing the blade any roots or other debris that may have become lodged therein may be easily discharged. Because of its compact size, the instant tool may be easily stored a small space for subsequent service.

It is to be understood that the present invention is not limited to the several embodiments described above, but encompasses any and all embodiments within the scope of the following claims.

I claim:

1. A hand-held trenching tool, comprising:

a cylindrical blade having opposite ends and an opening therebetween, each of said opposite ends defining a planar, cutting edge having a forwardmost point at its bottom, each said cutting edge sloping upwardly and rearwardly from said forwardmost point; and, an elongated handle having first and second ends, said first end being secured to the top of said cylindrical blade, said second end being adapted to receive a resilient hand grip, and said elongated handle being inclined toward one said cutting edge.

2. The trenching tool according to claim 1 further including a plate secured to one said cutting edge for retaining excavated material within said blade.

* * * * *